US005405034A

United States Patent [19]

Mittel, Jr.

[11] Patent Number: 5,405,034

[45] Date of Patent: Apr. 11, 1995

[54] CLOSURE DEVICE

[76] Inventor: Joseph C. Mittel, Jr., 49 Wrangler Rd., Simi Valley, Calif. 93065

[21] Appl. No.: 237,326

[22] Filed: May 3, 1994

Related U.S. Application Data

[63] Continuation of Ser. No. 873,447, Apr. 24, 1992, abandoned.

[51] Int. Cl.[6] ..... B65D 43/12

[52] U.S. Cl. ..... 215/322; 215/349; 215/350; 220/254; 220/346; 220/347; 220/351

[58] Field of Search ..... 215/322, 331, 347, 349, 215/350; 220/345, 346, 347, 349, 351, 254

[56] References Cited

U.S. PATENT DOCUMENTS

| | | | |
|---|---|---|---|
| 886,925 | 5/1908 | Betts et al. | 215/322 |
| 988,116 | 3/1911 | Lee et al. | 215/322 |
| 1,247,848 | 11/1917 | List . | |
| 1,314,065 | 8/1919 | Jackson | 220/331 X |
| 1,526,213 | 2/1925 | Humphrey . | |
| 1,897,890 | 2/1933 | Cook . | |
| 2,118,879 | 5/1938 | Chesley . | |
| 2,370,997 | 3/1945 | Rudolph | 215/322 X |
| 2,388,050 | 10/1945 | Guarnaschelli | 215/322 |
| 2,436,297 | 2/1948 | Guarnaschelli | 215/322 |
| 2,792,144 | 5/1957 | Mayer . | |
| 2,881,942 | 4/1959 | Allbright et al. | 220/347 |
| 3,422,997 | 1/1969 | Anderson | 215/322 X |
| 3,783,999 | 1/1974 | Smith . | |
| 3,858,740 | 1/1975 | Lestaevel . | |
| 4,048,050 | 9/1977 | Hillman . | |
| 4,174,034 | 11/1979 | Hoo | 220/347 X |
| 4,420,079 | 12/1983 | Gliniorz . | |
| 4,505,400 | 3/1985 | Bennett . | |
| 4,615,461 | 10/1986 | Liu | 220/345 X |
| 4,801,033 | 1/1989 | Kanner . | |
| 5,116,758 | 5/1992 | Verma | 215/322 X |

FOREIGN PATENT DOCUMENTS

| | | | |
|---|---|---|---|
| 38196 | 12/1926 | Denmark | 215/322 |
| 917849 | 11/1945 | France . | |

*Primary Examiner*—Allan N. Shoap
*Assistant Examiner*—Stephen Croni
*Attorney, Agent, or Firm*—Merchant, Gould, Smith, Edell, Welter & Schmidt

[57] ABSTRACT

A closure apparatus for a container includes an adapter which is mounted on or otherwise integrally formed with the container adjacent the container opening, and a cap which is moveable between an opened position and a closed position over the container opening. A coupling mechanism is provided for interconnecting the cap to the adapter so as to enable the cap to slide relative to the adapter between the opened and a closed position. A clamping mechanism, preferably provided by opposing ramped surfaces on the adapter and cap, is provided ton cooperate with the coupling means whereby the cap is urged into pressing engagement with the adapter over the container opening as the cap slides into the closed position.

19 Claims, 6 Drawing Sheets

FIG.19A
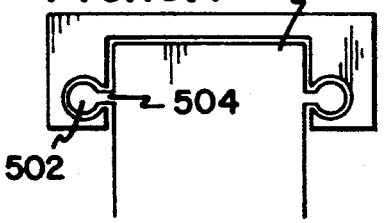
FIG.20
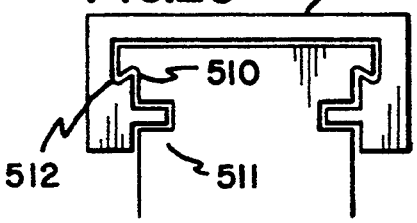
FIG.19B
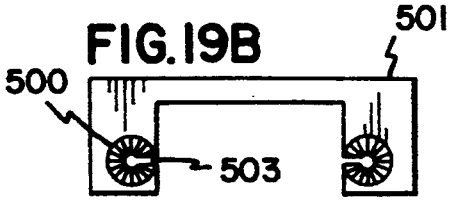
FIG.21
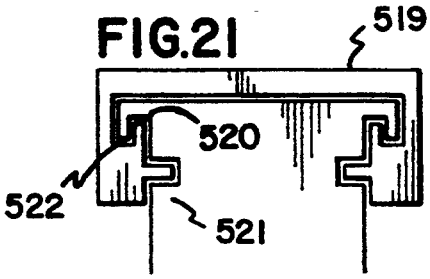
FIG.22
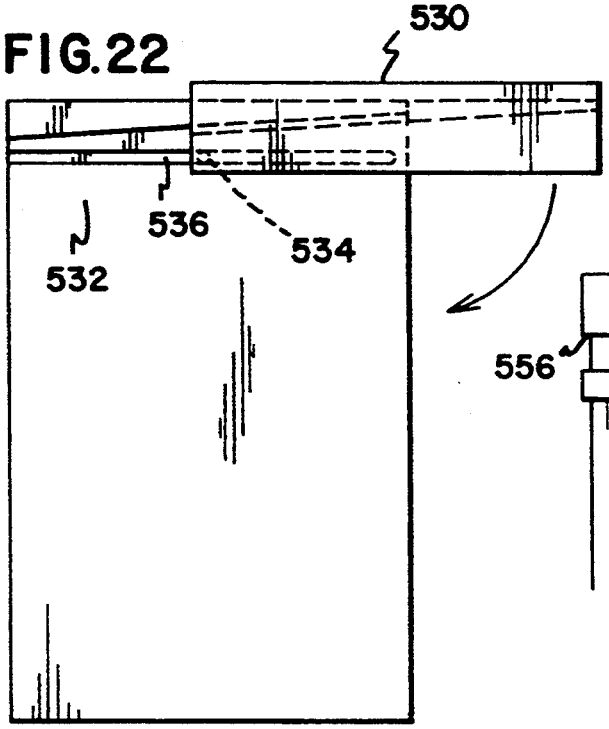
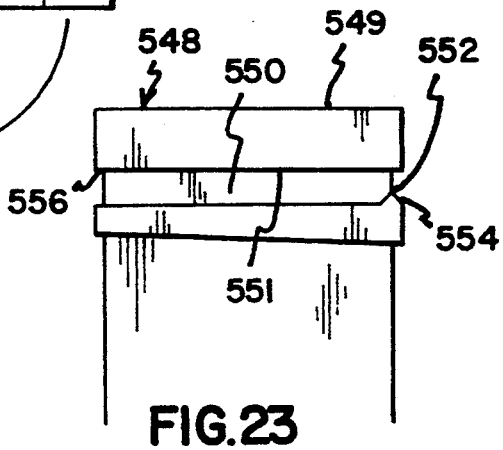
FIG.23
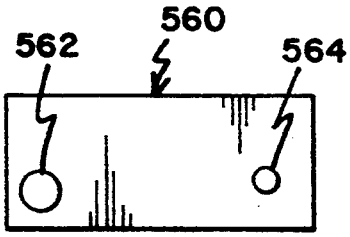
FIG.24
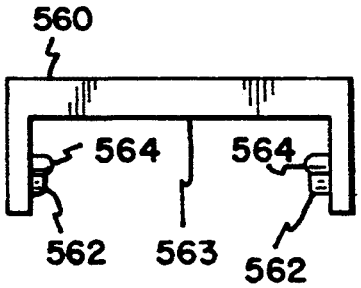
FIG.25

CLOSURE DEVICE

This is a continuation of application Ser. No. 07/873,447, filed Apr. 24, 1992, which was abandoned upon the filing hereof.

BACKGROUND OF THE INVENTION

The present invention relates generally to closure mechanisms for containers and more particularly to a closure mechanism whereby a cap is slidably coupled to an adapter affixed to or integrally formed with the top of the container whereby the cap may be retained on the container and the cap clamped against the adapter in response to sliding movement of the cap relative to the adapter against opposing ramped surfaces.

Various closure devices for containers have been devised. For example, French Patent No. 917,849 describes a cap mechanism and a separate pivotal removal mechanism with a pin positioned in a slot to attach the cap to the container. The cap moves laterally until the pin is in a narrow part of the slot at which point a flange is engaged under a lip of the cap. As the device is pivoted, the cap is forced loose after which it remains attached. The cap is then moveable along the groove to a position adjacent to the side of the bottle. However, this device does not provide a clamping mechanism whereby coaction between opposing ramped surfaces and the connecting mechanism effects clamping between a cap and an adapter whereby the slot and pin, in cooperation with ramped surfaces, enable clamping as well as pivotal movement.

Another pin and slot mechanism, but without a clamping mechanism provided by opposing ramped surfaces, is illustrated in Mayer U.S. Pat. No. 2,792,144.

Other closure devices have incorporated opposing ramped surfaces such as the container closure structure in Allbright, et al., U.S. Pat. No. 2,881,942. However, the Allbright closure mechanism does not incorporate a pin and slot mechanism whereby the top is retained on the container and facilitates the clamping action between the opposing ramped surfaces.

The present invention therefore provides a novel closure apparatus which incorporates a pin and slot interconnection means between a cap and an adapter and which also incorporates at least one ramped surface which cooperates with the pin and slot to pull the cap into a tight fit over the top of the container as the cap moves from an opened position to a closed position.

The present invention may also be incorporated in virtually any type container where a lid or other closure mechanism is employed including bowls, dishes, trays, wastebaskets, trash cans, pitchers, boxes and even doors. For example, the invention may be incorporated in toy boxes whereby the lid of the toy box slides to one side (or to the front or back) and then pivots into a stored position against the side (or front or back) of the box thereby enhancing safety by preventing the lid of the box from dropping down onto a child's hands, fingers or head. In certain configurations where the container has limited depth, the lid may be further pivoted into a stored position underneath the box.

SUMMARY OF THE INVENTION

A closure apparatus for a container includes an adapter which is mounted or otherwise integrally molded with and on the top of the container adjacent to the container opening and a cap which is moveable relative to the adapter between an opened position and a closed position over the container opening. The cap is attached to the adapter by a coupling mechanism, or a coupler, which enables the cap to slide relative to the adapter between the closure position and the non-closure position while being retained on the adapter, and hence the container. Additionally, the present invention includes a clamping apparatus interposed between the adapter and the cap whereby the adapter and the cap are urged into a pressing engagement with each other to close the container as the cap slides from the opened position into the closure position. In one specific embodiment, the adapter mounted to or integrally formed with the container has an upwardly facing adapter closure surface with a center opening aligned with the container opening. The adapter has a pair of outwardly facing side surfaces each of which has a slot extending generally parallel to the adapter top surface with a slot stop at one end. An outwardly projecting lip from each side surface defines a down-facing ramped surface relative to the adapter closure surface. The cap has a top member with a down-facing cap closure surface positioned to engage the adapter closure surface to close the container opening. The cap further has a pair of side members which extend down from the opposing edges of the top member with each side member having an inwardly projecting lip defining an upwardly projecting surface ramped relative to the cap closure surface and juxtaposed in facing relationship to one of the downwardly facing ramped surfaces of the adapter. The cap finally has a pair of inwardly projecting retention pins which are positioned to engage the slots in the adapter. Thus, the cap is slidingly retained on the adapter. The cap ramped surfaces and the adapter ramped surfaces engage each other so as to urge the cap closure surface toward the adapter closure surface as the cap is slidingly moved relative to the adapter into a closure position over the container opening.

Various mechanisms comprising the clamping means may be incorporated to provide the opposing ramped surfaces. For example, the slot itself may be ramped relative to the adapter and cap closure surfaces so that as the pin slides along the ramped slot, the closure surfaces are gradually brought into contact with one another. Similarly, the closure surfaces of the cap and adapter themselves may be ramped with two pins on each side, one smaller to allow it to disengage from the slot when the cap is in the opened position and one larger to be retained in the slot and hence keep the cap attached to the adaptor when the cap is in the opened position. Consequently, when the two pins move along each slot, the ramped surfaces come in contact and press against one another to provide the clamping between the cap and the adapter.

Finally, a suitable latch mechanism may be incorporated with the cap to latch the cap onto the adapter to selectively prevent sliding movement of the cap.

BRIEF DESCRIPTION OF THE DRAWINGS

A complete understanding of the present invention and of the above and other objects and advantages thereof may be gained from a consideration of the following description of the preferred embodiment taken in conjunction with the accompanying drawings in which:

FIGS. 19A and 19B are side views of the invention wherein the clamping mechanism is provided by a nested cone and conical slot arrangement on either side of the cap/adapter combination.

FIG. 20 is a side view of the invention wherein the clamping mechanism is provided by opposing curved or cupped ramped surfaces.

FIG. 21 is a side view of the invention wherein the clamping mechanism is provided by vertically oriented ramped surfaces.

FIG. 22 is a side view of the invention as applied to a deep box in contrast to the shallow box illustrated in FIGS. 12, 13 and 14.

FIG. 23 is a side view of an adaptor with a slot adapted to used with two pins to effect clamping.

FIGS. 24 and 25 is a side and front view respectively of a cap adapted to be used with the adaptor of FIG. 23.

DETAILED DESCRIPTION

Figure 1:
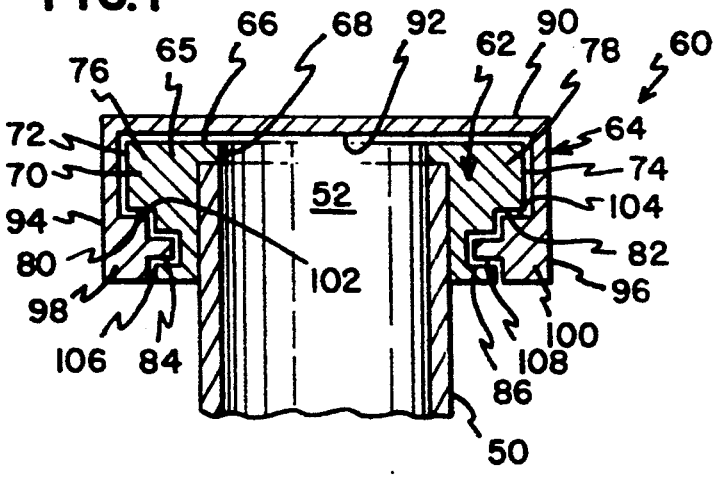
FIG. 1 is a front view of one embodiment of the invention showing the cap and adapter in place on a container.

Referring to FIG. 1, one embodiment of the container closure device 60 according to the invention is illustrated affixed to the top of a container 50 having a container opening 52 through which the interior of the container 50 is accessed. The container closure device 60 includes an adapter 62 which is shown affixed to but may be integrally formed with the container 50 adjacent the container opening 52 and a cap 64 which is movably attached to the adapter 62 in a manner to be described hereafter.

The adapter 62 includes a top adapter member 65 which defines an adapter closure surface 66 oriented to face upwardly away from the container opening 52. A downwardly projecting side member 70 projects down from the top adapter member 65 toward the container 50 and has a center opening 68 which is aligned with the container opening 52. The side member 70 defines at least a pair of outwardly facing flat side surfaces 72 and 74. The side surface 72 has an outwardly projecting lip 76 and the side surface 74 has an outwardly projecting lip 78. The outwardly projecting lip 76 defines a first down-facing adapter surface 80 and the outwardly projecting lip 78 defines a second down-facing adapter surface 82. The adapter surfaces 80 and 82 define ramped surfaces which cooperate with corresponding ramp surfaces in the cap to be described hereafter to effect a clamping of the cap 64 against the adapter closure surface 66.

The side surfaces 72 also includes an inwardly directed slot 84 and the side surface 74 includes an inwardly directed slot 86, where each of the slots 84 and 86 which are positioned below the ramped adapter surfaces 80 and 82 respectively.

The cap 64 has a top member 90 which defines a downwardly facing cap closure surface 92 positioned to press against the adapter closure surface 66 in response to the closure of the cap on the adapter in a manner to be described hereafter. The cap 64 also includes a pair of side members 94 and 96 each of which extend downwardly from opposite edges of the top member 90 adjacent the outwardly facing side surfaces 72 and 74 of the adapter 62. Extending inwardly from the lower portion of each of the side members 94 and 96 are inwardly projecting lips 98 and 100 which define a pair of cap ramped surfaces 102 and 104 aligned in facing relationship to the adapter ramped surfaces 80 and 82, respectively. Also extending from the lower portion of each side member 94 and 96 is a pair of retention pins 106 and 108 respectively, where the retention pins 106 and 108 are aligned to be inserted into the adapter slots 84 and 86 respectively.

Figure 2:
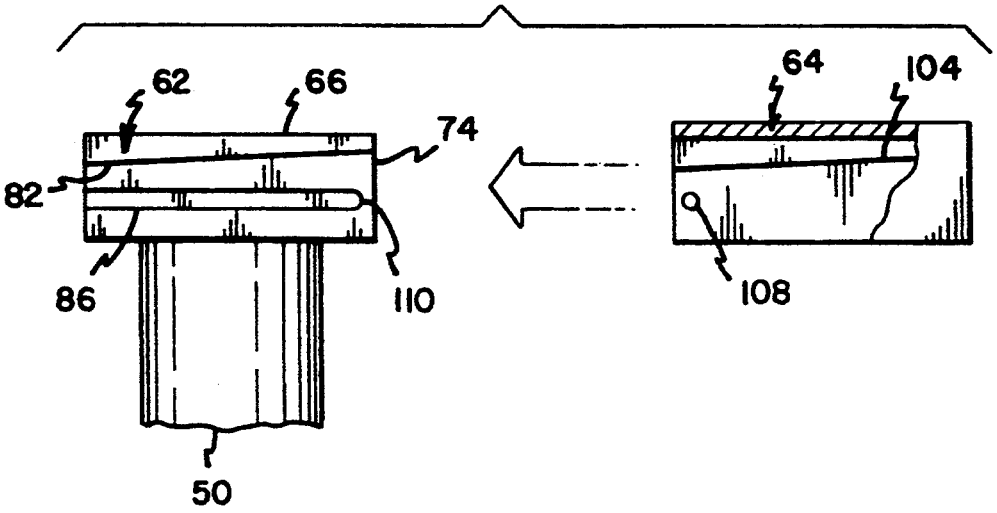
FIGS. 2, 3 and 4 are a side views of the embodiment of FIG. 1 illustrating the interconnection and movement of the cap relative to the adapter.

Turning to FIG. 2, a side view of the adapter 62 with the slot 86 extending along the side 74 illustrates the retention pin 108 of the cap 64 extending into the slot 86. In order to ensure that the pin remains in the slot 86, a slot stop such as slot stop 110 is positioned at one end of each of the slots. Also illustrated in FIG. 2 is the adapter ramped surface 82 and the opposing cap ramped surface 104. In operation, as the cap 64 with the pin 108 in the slot 86 is moved from a non-closure position where the pin is adjacent the slot stop 110 toward a closure position with the pin 108 positioned adjacent the open end of the slot, the cap ramped surface 104 and the adapter ramped surface 82 will be spaced apart from one another but will begin to move toward one another with the space between the two ramped surfaces decreasing until the pin nears the open end of the slot 86. At that time, the cap ramped surface 104 will contact and begin to slide along the adapter ramped surface 82 which will cause the cap closure surface 92 (FIG. 1) to move vertically toward the adapter closure surface 66 until the adapter closure surface and cap closure surface 66 and 92 respectively are tightly pressing against one another in clamping relationship caused by the pressing of the cap ramped surface 104 against the adapter ramp surface 82. This clamping effect will occur before the pin 108 reached the open end of the slot thereby preventing the cap from being removed from the adapter 62. By providing the two ramped surfaces which interact in such a way that as one slides along the other, the cap closure surface 92 will be forced toward and against the adapter closure surface 66, a tight closure over the opening of the adapter and hence the opening of the container 52 is thus achieved.

Figure 3:
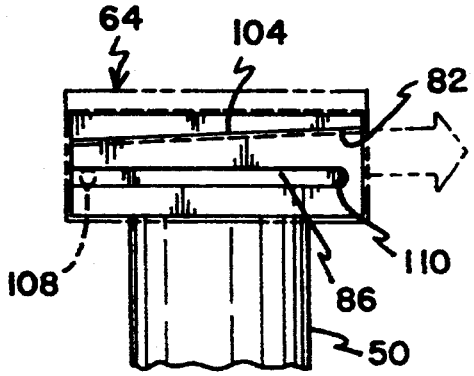
Figure 4:
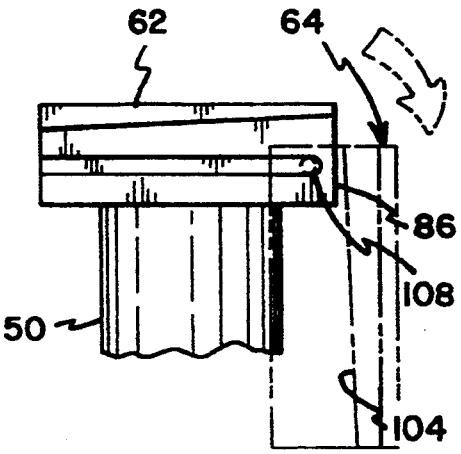

Referring to FIG. 3, when the cap 64 is moved from the closure position (with the pin 108 adjacent the open end of the slot 86) to the opened position (with the pin 108 adjacent the slot stop 110) the cap 64 can be pivoted 90 degrees and moved downwardly along the side of the container 50 in the manner described and illustrated in FIG. 3 and 4. Accordingly, the top 64 can be retained on the adapter member 62 adjacent to the side of the container 50 without the cap 64 being removed or lost while at the same time providing access to the interior of the container 50 through the opening in the adapter 62.

Figure 5:
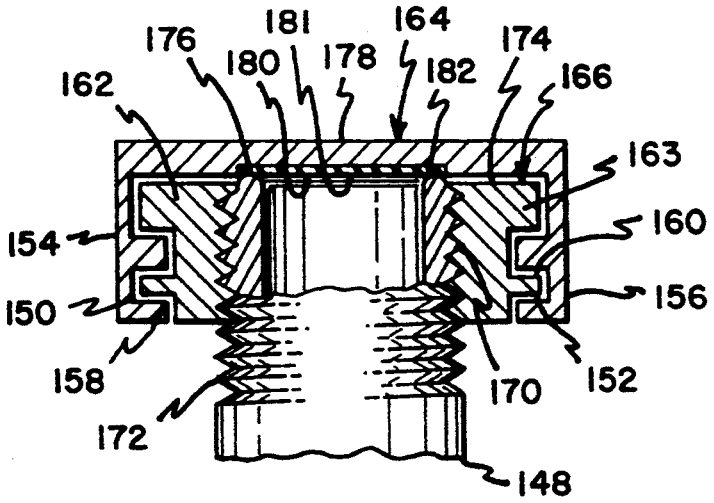
FIG. 5 is a side view of a second embodiment of the invention showing an alternative coupling mechanism between the cap and the adapter and also illustrating a mechanism for attaching the adapter to the container.

In FIG. 5 another embodiment of the invention is illustrated wherein slots 150 and 152 are disposed in side members 154 and 156, respectively, of cap 164. Suitable pins 158 and 160 respectively, are disposed to project from the side members 162 and 163 of the adapter 166 into the slots 150 and 152. Thus, the coupling means between the cap 164 and the adapter 166 is provided by the pins 158 and 160 extending from the adapter 166 into slots 150 and 152 in the cap 164 rather than from pins extending from the cap into slots in the adapter as illustrated in FIGS. 1 through 4.

The adapter 166 may have internal threads 170 which are adapted to mate with external threads 172 on the container 148 adjacent the opening of the container. The adapter 166 may then be screwed onto the top of the container 148. In one embodiment, an adapter closure surface 174 is positioned on the adapter 166 to extend circumferentially around the top of the container 148 so that an upper cylindrical lip 176 of the container 148 extends slightly above the closure surface 174 of the adapter 166. The cap 164 is then provided with a top member 178 which optionally has a sealing ply 182 which may for example be positioned in a circular recess 181 which is about the same diameter as the container lip 176 to define a cap closure surface 180 in juxtaposition with at least the upper cylindrical lip 176 of the container 148 so that when the adapter 166 is screwed onto the container 148, the upper cylindrical lip 176 of the container 148 will extend slightly above the adapter closure surface 174 so as to extend into the recess 181 and, if a sealing ply is present, to come in contact with, and resiliently press against the sealing ply 182, while extending into the recess 181 to retain and provide locking and additional sealing even after the cap 164 has been moved into its closed position relative to the adapter 166.

In operation, the adapter 166 is initially screwed onto the top of the container 148 so that the container cylindrical upper lip 176 is either flush with or below the closure surface 174 of the adapter. After the cap 164 has been moved into its closure position with the adapter closure surface 174 adjacent to and pressing against the cap closure surface 180, the adapter 166 is rotated slightly to cause the container upper lip 176 to move into the recess to lock the cap onto the container. If the sealing ply is present, the slight rotation also causes the cap to additionally press against the resilient sealing ply 182 to provide a particularly effective air tight seal for the container 148.

Figure 6:
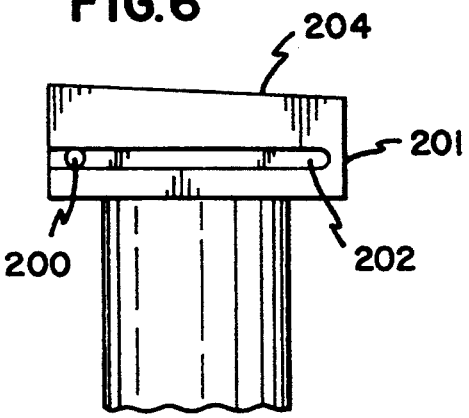
FIG. 6 is a side view of an adapter where the clamping surface comprises opposing ramped closure surfaces on the adapter.
Figure 7:
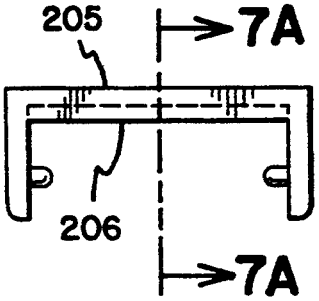
FIG. 7 and 7A is a front and side view respectively of a cap utilized with the adaptor of FIG. 6.
Figure 7A:
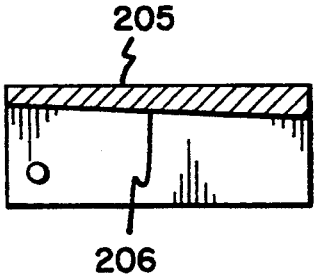

Referring to FIGS. 6, 7 and 7A, another embodiment of the invention is illustrated showing an optional clamping means. In FIGS. 1 through 5 the clamping means consisted of opposing ramped surfaces on the adapter and cap. The clamping means is provided by having the closure surface 204 of the adapter 201 and the closure surface 206 of the cap 205 being suitably ramped so that as the pin 200 moves along the slot 202 the ramped adapter closure surface 204 will come in contact with the ramped cap closure surface 206 with the clamping effect being provided by the edges of the pin 200 pressing against the edges of the slot 202 (and a corresponding pin and slot, not shown, on the opposite side of the adapter 201).

Figure 8:
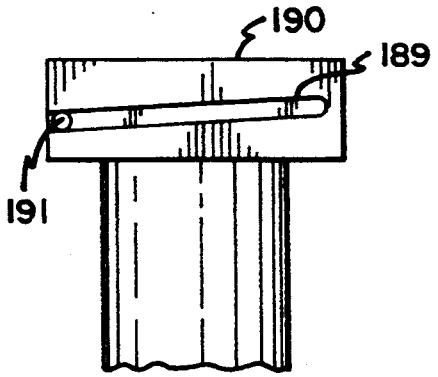
FIG. 8 is a side view of another embodiment of the invention wherein the clamping mechanism is provided by a ramped slot.

Turning to FIG. 8, and yet another embodiment of a clamping means is illustrated wherein the adapter closure surface and the cap closure are both flat as illustrated in FIG. 1 but the slot 189 in each side of the adapter 190 (or in each side of the cap) is ramped so that as the pin 191 moves along the slot 189, the cap closure surface and the adapter closure surface are urged toward one another until they are in a pressing, clamped closure position.

Figure 9:
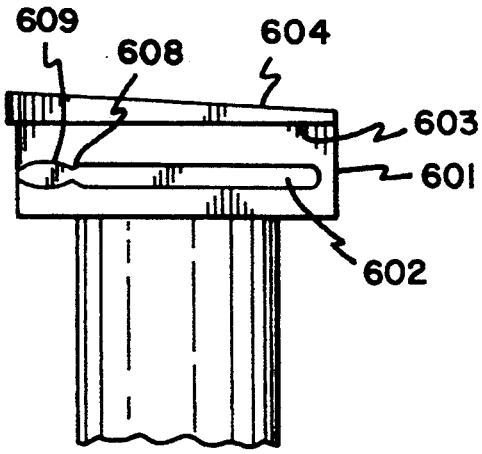
FIG. 9 is a side view of another embodiment of an adapter where the clamping surface comprises opposing ramped closure surfaces on the adapter.
Figure 10:
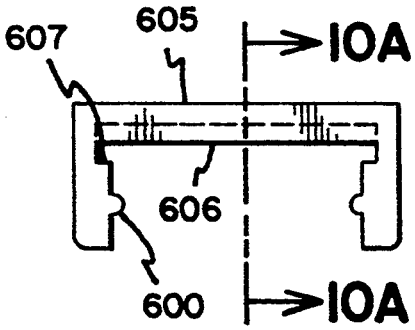
FIG. 10 and 10A is a front and side view respectively of a cap utilized with the adaptor of FIG. 9.
Figure 10A:
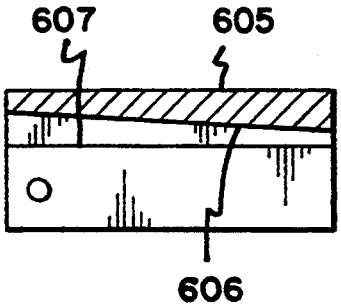

An alternative embodiment of the adaptor and cap arrangement in accordance with the invention is illustrated in FIGS. 9, 10 and 10A. As in FIGS. 6, 7 and 7A, the clamping means is provided by having the closure surface 604 of the adapter 601 and the closure surface 606 of the cap 605 being suitably ramped so that as the pin 600 moves along the slot 602 the ramped adapter closure surface 604 will come in contact with the ramped cap closure surface 606. The clamping effect is then provided by the edges of the pin 600 pressing against the edges of the slot 602 (and a corresponding pin and slot, not shown, on the opposite side of the adapter 601). To facilitate even clamping across the entire closure surface, opposing horizontal surfaces 603 in the adapter 601 and horizontal surface 607 in the cap 605 are provided to come in contact with each other as the ramped closure surfaces come in contact with each other.

To retain the cap 605 in the closed position on the adapter 604, the slot 602 may be provided with a narrowed neck region 608. In moving toward the closed position, the pin 600 can be pressed passed the neck 608 into a front slot region 609 where it will be retained until the pin 600 is again pressed through the neck region 608 to cause the cap to move into the open position.

Alternatively, as illustrated in FIGS. 23, 24 and 25, the adaptor 548 has a slot 550 with a narrowed region defined by a retention lip 554 adjacent one end 552 of the slot 550. A cap 560 illustrated in FIGS. 24 and 25 has a pair of pins 562 and 564. The front pin 562 has a diameter which is small enough to easily slide in the slot 550 but too large to be pulled past the lip 554. The rear pin 564 has a smaller diameter so that the pin 564 can move past the lip 554 and thereafter disengage from the slot 550. The slot is preferably ramped relative to the adaptor closure surface 549 and the cap closure surface 563.

In operation, as the cap 560 moves toward a closed position, the larger diameter pin will be positioned in the slot 550 near the end 556 of the slot 550 and the smaller diameter pin 564 will be positioned in the slot 550 near the end 552. The pins 562 and 564 will come into contact with and begin to press against the top edge 551 of the slot to cause the adaptor closure surface 549 and the cap closure surface to press against one another. When the cap 560 is moved toward the opened position, the pins 562 and 564 will slide along the slot 550 toward the end 552. When the pin 564 reaches the lip 554 is will move upward through the narrowed opening and be disengaged from the slot 550 allowing the cap 560 to pivot about the axis of pin 562. When the pin 562 reaches the end 552, the lip 554 will prevent further translational movement of the pin 562 toward the opening 552 and the cap can then be pivoted into a stored position next to the side of the container as illustrated in FIG. 4. The pins described in the various embodiments including pins 562 and 564 could be rigid protrusions or could be bearings or rollers.

Figure 11:
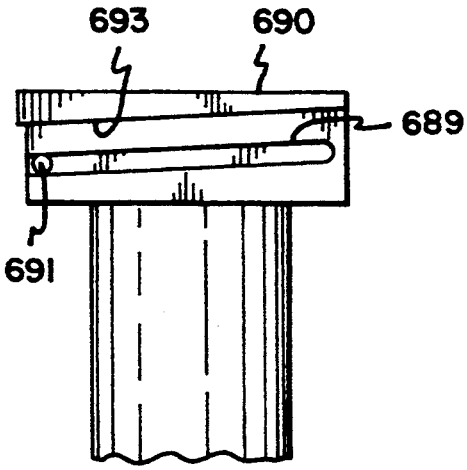
FIG. 11 is a side view of another embodiment of the invention wherein the ramped slot provides a means of more gradually mating the closure surfaces.

Turning to FIG. 11, yet another embodiment is illustrated wherein the adapter closure surface and the cap closure are both flat as illustrated in FIG. 1 but the slot 689 in each side of the adapter 690 (or in each side of the cap) is ramped so that as the pin 691 moves along the slot 689, the cap closure surface and the adapter closure surface are urged toward one another until they are in a pressing, clamped closure position. Because of the ramped positioning of the slot, the movement of the cap closure surface and the adapter closure surface toward each other as the cap slides into the closed position is more gradual.

Figure 12:
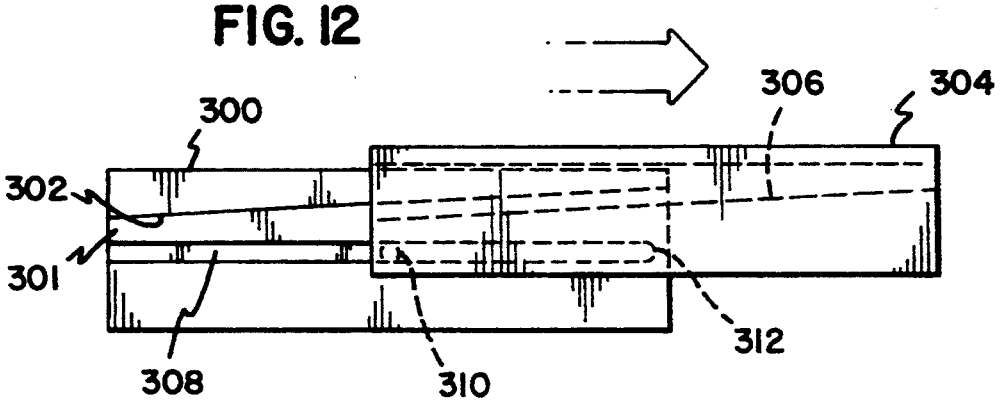
FIGS. 12, 13 and 14 are side views of the invention as applied to a shallow box.
Figure 13:
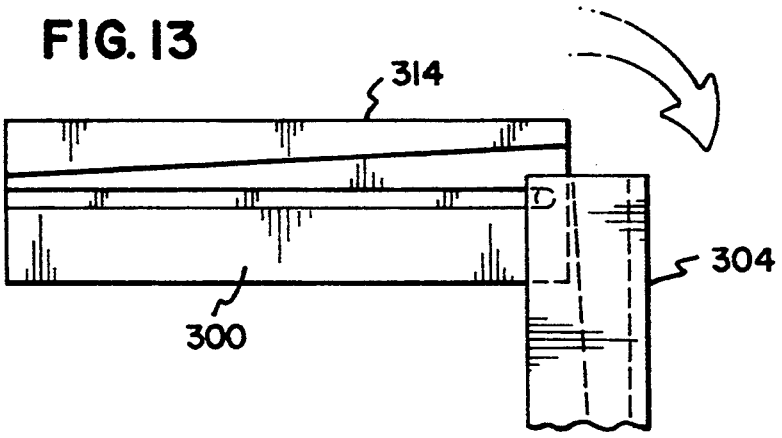
Figure 14:
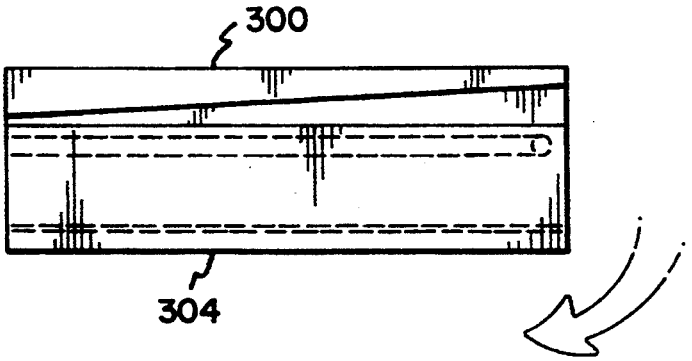

Turning to FIGS. 12, 13 and 14, the present invention may be incorporated as part of any container, not just a container with a circular or cylindrical opening. For example, the present invention is equally adaptable to a container with a square or rectangular opening such as a box where it is desired to keep the lid of the box attached to the body of the box while moving the lid into an out-of-the-way storage position when not covering the body of the box. Thus, FIG. 12 shows a square or rectangular box 300 wherein the adapter 301 includes a member defining an adapter ramped surface 302 with a top of 304 having a corresponding and opposing top ramp surface 306 which is juxtaposed in facing relationship to the adapter ramped surface 302 in a manner such as that illustrated in FIG. 1. A suitable slot 308 with a pin 310 extending from the top 304 into the slot 308 is provided in the manner such as that described in connection with FIG. 1.

As the top 304 is moved from a closed position with the pin 310 positioned adjacent the opened end of the slot 308 to the open position with the pin 310 against the slot stop 312, the adapter ramp surface 302 disengages from the top ramp surface 306. When the pin 310 reaches the slot stop 312, the entire top 304 can be pivoted downwardly to a stored position adjacent the side or end 314 of the box 300 as illustrated in FIG. 13. Further, compact storage of the top 304 can be achieved by further rotating the top through a full 180 degrees so that the bottom of the box fits into and nests in the top 304 in the manner shown in FIG. 14. Once the top is in this storage position, it is possible to easily remove the top from the box by sliding the pins along the slot until they exit the front of the slot. The top is thereby detached from the box. Of course, if the container is deep rather than shallow as illustrated in FIG. 22, then the top 530 of the closure apparatus will only rotate ninety degree when the pin 534 reaches the end of the slot 536 of the adapter 532.

Figure 15:
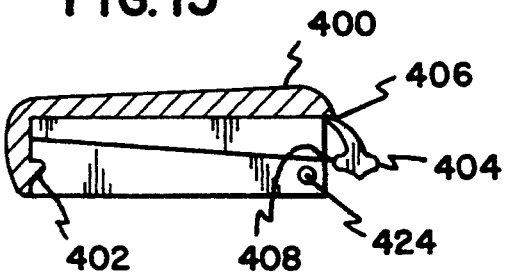
FIGS. 15, 16, 17 and 18 illustrate a releasable latch mechanism which may optionally be incorporated to releasably latch the cap to the adapter to prevent sliding movement of the cap relative to the adapter from a closure position to a non-closure position.
Figure 16:
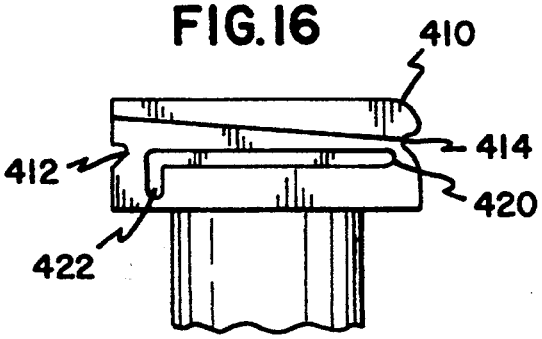

Turning to FIGS. 15, 16, 17 and 18, the present invention may further include a latch mechanism for latching the cap to the adapter. Referring particularly to FIG. 15, a typical cap member 400 includes a resilient but permanent inwardly protruding first retention nib 402 on the back side of the cap and a pivotal latch 404 on the front side opposite the back side. The latch 404 is pivotal about a pivot or hinge means 406 and includes a second retention nib 408. The cap 400 is adapted to mate with a suitable corresponding latch retention members on a adapter 410 illustrated in FIG. 16. The adapter 410 includes a first nib retention slot or groove 412 on its back side and a second nib retention slot 414 on it front side opposite the back side. The slots as above described are then in the sides connecting the front and back sides.

Figure 17:
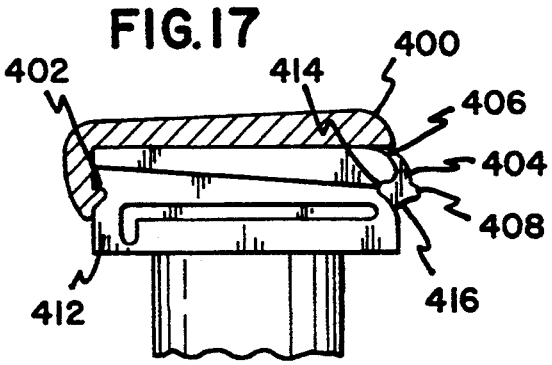
Figure 18:
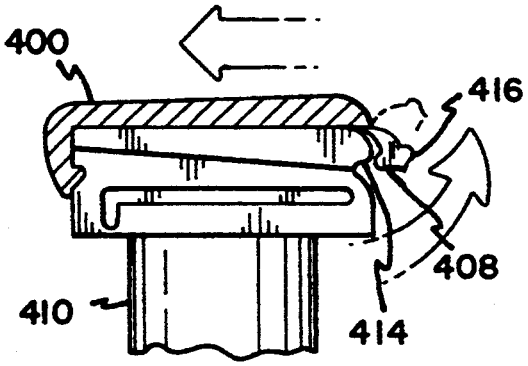

Turning to FIG. 17, the nib 402 is positioned in the nib slot 412 with the latch 404 pivoted until the nib 408 snaps into the nib slot 414. To unlatch the cap so it can be slidingly moved to an opened position, a lip 416 on the latch 404 is pressed upwardly to cause the latch 404 to move until the nib 408 is released from slot 414. The cap 400 is then pressed toward the non-closure position until the nib 402 to be displaced from the nib slot 412 thereby enabling the cap 400 to be slidingly moved from the closed position to the opened position.

Turning again to FIG. 16, the slot 420 may have a downwardly protruding portion 422. This portion 422 is provided so that when the cap is moved to the opened position and is rotated to a position next to the side of the container, the latch 404 will be located below the top surface of the adapter. This will occur as the pin 424 moves down the short slot portion 422. Otherwise, the latch 404 may protrude above the top of the adapter.

Various other embodiments of the invention are possible. For example, various configurations of clamping means are illustrated in FIGS. 19A, 19B, 20 and 21. In FIGS. 19A and 19B, the clamping means is a conically shaped slot 500 in the cap 501 with the adapter 505 having a mating conically shaped protrusion 502 positioned to slide in the slot 500. The protrusion 502 is joined to the adapter by a connecting member 504 which slides along a side slot 503 in the cap. A like clamping means configuration is provided on each side of the closure apparatus.

Another clamping configuration is illustrated in FIG. 20 where the opposing ramped surfaces 510 and 512 in the cap 509 and adapter 511 respectively, are not horizontal flat surfaces as illustrated in FIG. 1 but rather have a cupped or curved cross sectional shape. Also, as illustrated in FIG. 21, the opposing ramped surfaces 520 and 522 in the cap 519 and adapter 521 may be positioned in a vertical alignment.

Accordingly, the claims are intended to include all such embodiments and variations as fall within the true spirit and scope of the invention.

What is claimed is:

1. A closure apparatus suitable for any shape container having an opening to be selectively closed comprising:

an adapter on the container adjacent the container opening;

a cap movable between an opened position displaced from the container opening and a closed position over the container opening;

a coupler for mounting and retaining the cap to the adapter in both the opened and closed position, the coupler interconnecting the adapter and the cap for enabling the cap to slide in a single direction transverse to the container opening from the opened position to the closed position, the opened position being reached upon completion of the transverse sliding to a limit position on the adapter displaced from the container opening, the cap pivoting at the limit position about an axis adjacent to the opening, the axis being parallel to the plane of the opening; and a clamp apparatus interposed between the adapter and the cap for urging the adapter and the cap into pressing engagement with each other solely in response to the transverse sliding movement of the cap across the container opening from the opened position to the closed position.

2. The closure apparatus of claim 1 wherein the clamp apparatus comprises:

at least one first ramped surface on the adapter; and at least one second ramped surface on the cap, the first and second ramped surfaces Juxtaposed in facing relationship to each other for causing the cap and the adapter to press against each other in response to the first ramped surface contacting and sliding relative to the second ramped surface as the cap slides into the closed position.

3. The closure apparatus of claim 2 wherein the first ramped surface comprises an upwardly facing closure surface on the adapter and the second ramped surface comprises a downwardly facing closure surface on the cap.

4. The closure apparatus of claim 2 wherein:

the adapter comprises an upwardly facing adapter closure surface with a center opening therein for being aligned with the container opening, a pair of outwardly facing side surfaces each having an outwardly projecting lip defining a downwardly facing ramped surface, the at least one first ramped surface comprising the pair of downwardly facing ramped surfaces; and wherein the cap has a top member with a downfacing cap closure surface for engagement with the adapter closure surface to close the container opening, a pair of side members extending down from opposing edges of the top member, each side member having an inwardly projecting lip defining an upwardly facing ramped surface juxtaposed in facing relationship to one of the downwardly facing ramped surfaces of the adapter, the at least one second ramped surface comprising the pair of upwardly facing ramped surfaces.

5. The closure apparatus of claim 1 wherein the coupler comprises a pair of slots in a selected one of either the cap or the adapter and a pair of pins in the other of either the cap or the adapter, the pins positioned to extend into the pair of slots, the cap defining a cap closure surface and the adapter defining an adapter closure surface, the clamp apparatus comprising the pair of slots whereby the slots are in ramped orientation relative to the cap closure surface and the adapter closure surface.

6. A closure apparatus for a container having an opening to be selectively closed comprising:

an adapter on the container adjacent the container opening, the adapter having an upwardly facing adapter closure surface with a center opening therein for being aligned with the container opening, a pair of outwardly facing side surfaces each having a slot extending generally parallel to the adapter top surface with a slot stop at one end and an outwardly projecting lip defining a downwardly facing surface ramped relative to the adapter closure surface and the pair of slots;

a cap having a top member with a downfacing cap closure surface for engagement with the adapter closure surface to close the container opening, a pair of side members extending down from opposing edges of the top member, each side member having an inwardly projecting lip defining an upwardly facing surface ramped relative to the cap closure surface and juxtaposed in facing relationship to one of the downwardly facing surfaces of the adapter and an inwardly projecting retention pin positioned to engage one of the slots in the adapter whereby the cap is slidingly retained on the adapter, the cap ramped surfaces and the adapter ramped surfaces engaging each other for urging the cap closure surface toward the adapter closure surface as the cap is slidingly moved relative to the adapter into a closure position over the container opening.

7. The closure apparatus of claim 6 further comprising a resiliently compressible sealing ply positioned between the adapter closure surface and the cap closure surface.

8. The closure apparatus of claim 7 wherein the sealing ply is affixed to the cap closure ply.

9. The closure apparatus of claim 6 further wherein the container has a cylindrical external threaded region adjacent the container opening and the adapter has a cylindrical hole therethrough extending from the adapter closure surface, the cylindrical hole having an internal threaded region for mating with the external threaded region of the container.

10. The closure apparatus of claim 9 wherein the container has an upper cylindrical lip, the lip selectively positioned to extend slightly above the adapter closure surface for contacting the cap closure surface when the adapter is rotated into a locked position.

11. The closure apparatus of claim 10 further comprising a resiliently compressible sealing ply affixed to the cap closure ply, the container lip pressing against the sealing ply when the adapter is rotated into the locked position.

12. The closure apparatus of claim 11 wherein the cap has a recess deposed therein for being in juxtaposition with the container lip when the cap is in the closure position on the adapter, the sealing ply being positioned in the recess.

13. The closure apparatus of claim 6 further comprising latch means for latching the cap and the adapter together and preventing movement between the cap and the adapter when the latch means is engaged.

14. A closure apparatus for a container having an opening to be selectively closed comprising:

an adapter on the container adjacent the container opening, the adapter having an upwardly facing adapter closure surface with a center opening therein for being aligned with the container opening, a pair of outwardly facing side surfaces each having an outwardly protecting retention pin and an outwardly protecting lip defining a downwardly facing surface ramped relative to the adapter closure surface;

a cap having a top member with a downfacing cap closure surface for engagement with the adapter closure surface to close the container opening, a pair of side members extending downwardly from opposing edges of the top member, each side member having an inwardly protecting lip defining an upwardly facing surface ramped relative to the cap closure surface and juxtaposed in facing relationship to one of the downwardly facing ramped surfaces of the adapter, and a slot extending generally parallel to the cap closure surface with a slot stop at one end, each adapter retention pin slidingly positioned in one of the slots in the cap whereby the cap is slidingly retained on the adapter, the cap ramped surfaces and the adapter ramped surfaces engaging each other for urging the cap closure surface toward the adapter closure surface as the cap is slidingly moved relative to the adapter into a closure position over the container opening; and a resiliently compressible sealing ply positioned between the adapter closure surface and the cap closure surface.

15. The closure apparatus of claim 14 wherein the sealing ply is affixed to the cap closure surface.

16. The closure apparatus of claim 14 wherein the container has a cylindrical external threaded region adjacent the container opening and the adapter has a cylindrical hole therethrough extending from the adapter closure surface, the cylindrical hole having an internal threaded region for mating with the external threaded region of the container.

17. The closure apparatus of claim 16 wherein the container has an upper cylindrical lip, the lip selectively positioned to extend slightly above the adapter closure surface for contacting the cap closure surface when the adapter is rotated into a locked position.

18. The closure apparatus of claim 17 further comprising a resiliently compressible sealing ply affixed to the cap closure ply, the container lip pressing against the sealing ply when the adapter is rotated into the locked position.

19. The closure apparatus of claim 14 further comprising latch means for latching the cap and the adapter together and preventing movement between the cap and the adapter when the latch means is engaged.

* * * * *

UNITED STATES PATENT AND TRADEMARK OFFICE
CERTIFICATE OF CORRECTION

PATENT NO. : 5,405,034

DATED : April 11, 1995

INVENTOR(S) : Joseph C. Mittel, Jr.

It is certified that error appears in the above-identified patent and that said Letters Patent is hereby corrected as shown below:

Title page, item [57],
In the Abstract, after "provided" and before "cooperate", "ton" should read --to--;

In column 2, line 12, after "the" and before "position", "closure" should read --closed--;

In column 3, line 1, after "are" and before "side", strike "a"; and line 45, after "to" (first occurrence) and before "used" insert --be--;

In column 6, line 62, after "554" and before "will", "is" should read --it--;

In column 7, line 54, after "ninety" and before "when", "degree" should read --degrees--; line 65, after "with" and before "suitable" strike "a"; line 66, after "on" and before "adapter" (first occurrence) strike "a" and substitute therefor --an--; and line 68, after "on" and before "front" strike "it" and substitute therefor --its--;

In column 9, line 7, after "surfaces" and before "in", "Juxtaposed" should read --juxtaposed--.

Signed and Sealed this

Twenty-second Day of August, 1995

Bruce Lehman

*Attest:*

BRUCE LEHMAN

*Attesting Officer*

*Commissioner of Patents and Trademarks*